US005271129A

United States Patent [19]

Clarke et al.

[11] Patent Number: 5,271,129

[45] Date of Patent: Dec. 21, 1993

[54] SEAT BELT BUCKLE

[75] Inventors: Ron Clarke, Holywood; Brian M. Martin, Newtownabbey, both of Ireland

[73] Assignee: General Motors Corporation, Detroit, Mich.

[21] Appl. No.: 347,533

[22] Filed: May 4, 1989

[30] Foreign Application Priority Data

May 11, 1988 [GB] United Kingdom ..... 8811139

[51] Int. Cl.[5] ..... A44B 11/25

[52] U.S. Cl. ..... 24/641; 24/643

[58] Field of Search ..... 24/641, 642, 643, 646, 24/609, 655, 684

[56] References Cited

U.S. PATENT DOCUMENTS

| | | | |
|---|---|---|---|
| 4,388,746 | 6/1983 | Krutz et al. | 24/643 |
| 4,451,958 | 6/1984 | Robben et al. | 24/641 |
| 4,527,317 | 7/1985 | Straszewski et al. | 24/641 |
| 4,543,693 | 10/1985 | Cunningham | 24/641 |

*Primary Examiner*—Victor N. Sakran
*Attorney, Agent, or Firm*—Charles E. Leahy

[57] ABSTRACT

A seat belt buckle 10, adapted to releasably engage with a latch plate 24 insertable within a latch passage 22 in the seat belt buckle 10, comprises: a rigid frame 12 having an open forward end 11 defining the latch passage 22, an opposite rearward end 13 adapted to be attached to a seat belt, an apertured rectangular base plate 14, an upstanding side wall 16 extending from each longitudinal edge of the base plate 14, and a fixed bar 18 extending across the width of the base plate 14 between the forward and rearward ends thereof, parallel to, and spaced apart from, the base plate 14, the fixed bar 18 being secured at each end thereof to a respective side wall 16. A locking member 26 is pivotally supported by said frame side walls 16 so as to pivot about an axis substantially parallel to, and spaced apart from, the fixed bar 18 of the frame, between a latched position as shown, in which the locking member 26 retains the latch plate 24 within the latch passage 22 in the buckle 10, and an unlatched position, in which the locking member 26 is held clear of the latch passage 22. A shaped blocking member 46 is slidably mounted upon the locking member 26 for longitudinal movement relative to the locking member 26 between a first position, where the locking member 26 is in the latched position and the blocking member 46 is interposed between the fixed bar 18 and the locking member 26 to block any pivotal movement of the locking member 26 towards the unlatched position, and a second position, where the locking member 26 is in the unlatched position and the blocking member 46 engages the fixed bar 18 to retain the locking member 26 in the unlatched position. A push button 20 is slidably mounted on the frame side walls 16 above the latch passage 22, for longitudinal movement relative to the frame base plate 14 so as to move the blocking member 46 from the first position to the second position. A coil spring 54 located between the blocking member 46 and the locking member 26 biases the blocking member 46 towards the first position. The fixed bar 18 is provided with a substantially knife-edged portion 27 which faces the rearward end 13 of the buckle 10 and extends across the width of the base plate; and the shaped blocking member 46 is provided with a sloping face 50 which makes essentially a line contact with the substantially knife-edged portion 27 of the fixed bar 18 throughout the pivotal movement of the locking member 26 from the unlatched position to a position in which the coil spring 54 can snap the blocking member 46 into the first position.

6 Claims, 2 Drawing Sheets

SEAT BELT BUCKLE

This invention relates to seat belt buckles for seat belts in motor vehicles. In particular, this invention relates to a seat belt buckle which includes a locking member pivoted in a frame of the buckle and adapted to engage and retain a separate latch plate inserted into the buckle until the locking member is released by pressure on a push button slidably mounted on the buckle frame.

Seat belt buckles having a latch passage into which a separate latch plate can be inserted against the force exerted by a spring-biased ejector located in the passage until the latch plate engages with, and is retained by, a pivoted locking member are well known, particularly where the latch plate is released from the engagement with the pivoted locking member by pressure on a press button slidably mounted in the buckle.

Desirable features in such seat belt buckles comprise easy and effective latching of the latch plate in the seat belt buckle, easy release of the latch plate by pressure on the push button, and the ability to retain the latch plate in a latched position in the buckle even when the latch plate and buckle are subjected to heavy impact loading. This last-mentioned feature is achieved in many seat belt buckles by the inclusion of a blocking member movably mounted in the buckle frame, which blocking member is moved over the pivoted locking member when that member is engaged with the latch plate, so as to prevent any risk of the pivoted locking member rising inadvertently to release the latch plate when the buckle is subjected to heavy impact loading. One example of such a seat belt buckle is disclosed in U.S. Pat. No. 4,388,746. The present invention represents an improvement over these types of seat belt buckle.

A seat belt buckle according to the present invention, adapted to releasably engage with a latch plate insertable within a latch passage in the seat belt buckle, comprises: a rigid frame having an open forward end defining said latch passage, an opposite rearward end adapted to be attached to a seat belt, an apertured rectangular base plate, an upstanding side wall extending from each longitudinal edge of said base plate, and a fixed bar extending across the width of said base plate between the forward and rearward ends thereof, parallel to, and spaced apart from, said base plate, said fixed bar being secured at each end thereof to a respective side wall; a locking member pivotally supported by said frame side walls so as to pivot about an axis substantially parallel to, and spaced apart from, said fixed bar of said frame, between a latched position, in which the locking member retains said latch plate within said latch passage in the buckle, and an unlatched position, in which the locking member is held clear of said latch passage; a shaped blocking member slidably mounted upon said pivoted locking member for longitudinal movement relative to said locking member between a first position, where the locking member is in said latched position and the blocking member is interposed between said fixed bar and said locking member to block any pivotal movement of the locking member towards said unlatched position, and a second position, where the locking member is in said unlatched position and the blocking member engages the fixed bar to retain the locking member in said unlatched position; a push button slidably mounted on said frame side walls above said latch passage, for longitudinal movement relative to the frame base plate so as to move said blocking member from said first position to said second position; and a spring means located between the blocking member and the locking member which biases the blocking member towards said first position; the fixed bar being provided with a substantially knife-edged portion which faces the rearward end of the buckle and extends across the width of the base plate; and the shaped blocking member being provided with a sloping face which makes essentially a line contact with the substantially knife-edged portion of the fixed bar throughout the pivotal movement of the locking member from said unlatched position to a position in which the spring means can snap the blocking member into said first position.

Preferably, the sloping face of the shaped blocking member is a cambered surface which is inclined towards a substantially planar portion of the locking member upon which the shaped blocking member is slidably mounted, and an abutment on the push button engages the cambered surface of the shaped blocking member in order to move the shaped blocking member from said first position to said second position, said abutment being provided with a sloping contact surface which is complementary to the cambered surface of the shaped blocking member.

In a preferred embodiment of the present invention, the shaped blocking member is formed from a high strength, mouldable synthetic plastics material, such as a linear polyoxymethylene-type acetal resin produced from the polymerization of formaldehyde.

Advantageously, the fixed bar is a steel bar having a trapezium-shaped cross-section comprising a first side, a second side opposed to, and parallel to the first side, and two remaining sides which are opposed and non-parallel to one another and converge from said first side towards said second side, said fixed bar having said first side facing downwards towards the base plate of the frame; and the substantially knife-edged portion is formed by the edge of the bar between said first side and the non-parallel side which faces the rearward end of the buckle.

The invention and how it may be performed are hereinafter particularly described with reference to the accompanying drawings, in which.

Figure 1:
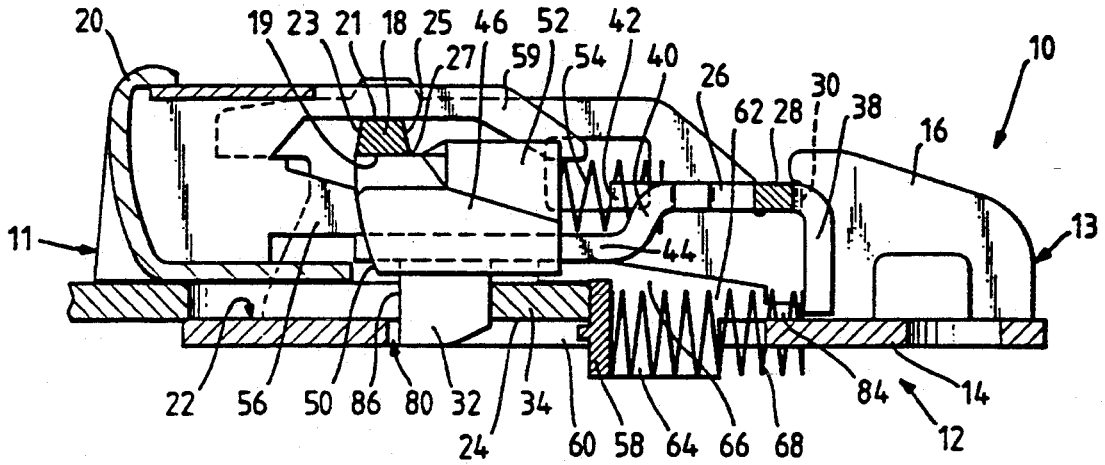
FIG. 1 is a cross-sectional view of a seat belt buckle according to the present invention, showing the buckle in a latched condition with a latch plate.

FIG. 1 shows a seat belt buckle 10 according to the present invention which comprises a rigid frame 12 having an open forward end 11, an opposite rearward end 13 adapted to be attached to a seat belt (not shown), an apertured rectangular base plate 14 and side plates 16, only one of which is shown in FIG. 1, each one of which extends upwards from a respective longitudinal edge of the base plate 14. A fixed bar 18 extends across the space between the side plates 16 parallel to, and spaced apart from, the apertured base plate 14. The fixed bar 18 is a steel bar having a trapezium-shaped cross-section comprising a first side 19, a second side 21 opposed to, and parallel to the first side 19, and two remaining sides 23 and 25 which are opposed and non-parallel to one another and converge from the first side 19 towards the second side 21. The fixed bar 18 is located in trapezium-shaped apertures in the side plates 16 so that the first side 19 of the bar faces downwards towards the base plate 14 of the frame 12, and the non-parallel side 25 faces the rearward end 13 of the frame 12. The first side 19 of the fixed bar 18 meets the non-parallel side 25 at an edge 27 which forms a substantially knife-edged portion extending across the width of the base plate 14 and facing the rearward end 13 of the frame.

A push button 20 is slidably mounted between the side plates 16 for to and fro movement with respect to, and substantially parallel with, the apertured base plate 14, the push button 20 being spaced apart from the apertured base plate 14 so as to define a rectangular slot-like passage 22 therebetween at the open forward end 11 of the frame 12, to allow access of an apertured latch plate 24 into the buckle 10.

A locking member 26 is pivoted between the side plates 16 on integral wing portions 28 (see FIG. 3), each of which extends from a respective side of the locking member 26 and is located in an open pivot recess 30 in a respective side plate 16, so that the locking member 26 pivots about an axis extending across the space between the side plates 16 that is substantially parallel to both the axis of the fixed bar 18 and the plane of apertured base plate 14. Locking member 26 can pivot between a latched position, shown in FIG. 1, in which an integral dependent lock bar 32 engages behind an integral cross-bar 34 of the apertured latch plate 24, and an unlatched position, shown in FIG. 2, in which a bottom surface 36 of the lock bar 32 is raised above the rectangular slot-like passage 22 provided for the apertured latch plate 24. As can be seen from FIGS. 1 and 3, each open pivot recess 30 is formed as an aperture through the respective side plate 16 having an adjacent section of the side plate removed to allow the easy insertion of the respective wing portion 28 into the recess 30 during the assembly of the buckle 10.

Figure 2:
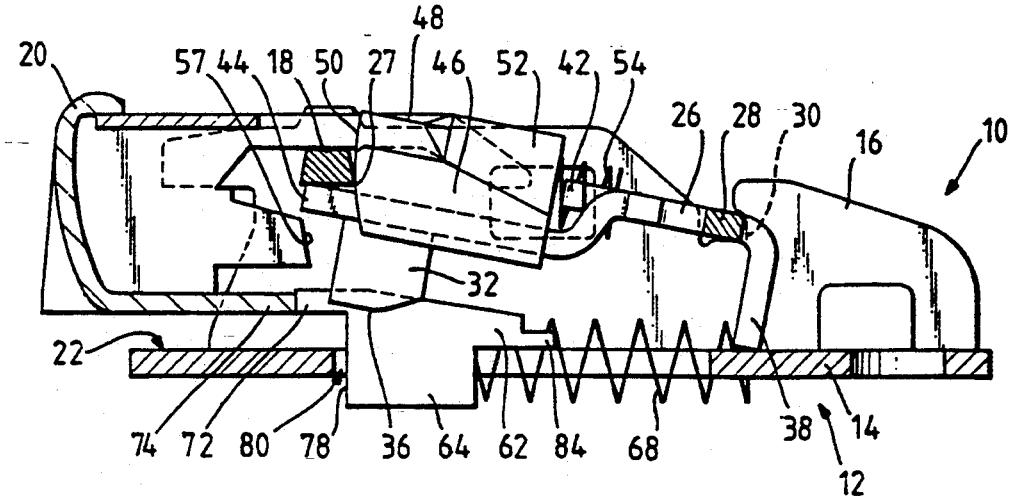
FIG. 2 is a cross-sectional view of the seat belt buckle shown in FIG. 1, showing the buckle in an unlatched position.

Locking member 26 has two dependent legs 38, only one of which is shown in the drawings, which extend from adjacent the pivot axis of the locking member 26 to close to the apertured base plate 14, which legs 38 move between the position shown in FIG. 1, where they are upright with respect to apertured base plate 14, to a forward, inclined position shown in FIG. 2, as the locking member 26 pivots between the latched and unlatched positions. As can be seen in FIGS. 1 and 2, the locking member 26 includes a downwardly-cranked portion 40 forward of each wing portion 28, and a central limb 42. The remaining portion of locking member 26 takes the form of a substantially rectangular planar portion 44 extending forwardly from the two downwardly-cranked portions 40 to overlie the rectangular slot-like passage 22, and carries the dependent lock bar 32. As can be seen in FIG. 1, when the buckle 10 is in the latched condition, planar portion 44 of the locking member 26 is substantially parallel to apertured base plate 14.

A shaped slider block 46 is slidably mounted upon the planar portion 44 of locking member 26 for sliding movement to and fro in a direction parallel to the direction of insertion of the apertured latch plate 24 into the rectangular slot-like aperture 22 in the buckle 10. The shaped slider block 46 includes a substantially flat upper surface 48, a cambered forward surface 50 and a centrally-placed, rearwardly-extending spring housing 52. The cambered forward surface 50 is inclined towards the planar portion 44 of the locking member 26. A helical coil spring 54 has one end thereof located within the rearwardly-extending spring housing 52 of slider block 46 and the other end thereof located over the end of the central limb 42 of locking member 26, and biases the slider block 46 towards the forward end of planar portion 44. The dimensions of the slider block 46 are such that, when the buckle is in the latched condition shown in FIG. 1, the slider block 46 can slide under the fixed bar 18 with the flat upper surface 48 of the slider block 46 in contact with the first side 19 of the fixed bar 18, under the spring bias exerted by coil spring 54. The forward movement of slider block 46 beneath the fixed bar 18 is limited by the slider block 46 contacting abutments 56 formed on push button 20. Shaped slider block 46 is moulded from a high strength synthetic plastics material, such as a linear polyoxymethylene-type acetal resin produced from the polymerization of formaldehyde. An example of such an acetal resin is the acetal resin sold under the trade name of Delrin.

Rearward movement of the shaped slider block 46 on the planar portion 44 is produced by transmitting pressure applied to the push button 20 through abutments 56 on push button 20 which are in contact with the cambered forward surface 50 of the slider block 46 when the buckle is in the latched condition. Abutments 56 are positioned on the push button 20 so as to pass under the first side 19 of the fixed bar 18 during the rearward movement of the shaped slider block 46 that is required to place the buckle into the unlatched condition shown in FIG. 2. Each abutment 56 has an inclined contact face 57 which is complementary to the cambered forward surface 50 of the slider block 46. Push button 20 includes two rearwardly-extending arms 59, only one of which is shown in FIG. 1, which traverse the second side 21 of fixed bar 18 and terminate in outwardly-extending ears 61 (see FIG. 3) which are slidably housed in respective rectangular apertures formed in the side plates 16 of the frame 12, and form the means whereby the push button 20 is slidably mounted for to and fro movement on the frame 12.

The buckle 10 also includes a shaped ejector 58 which is slidably mounted upon the apertured base plate 14 for to and fro movement within an aperture 60 in the base plate 14, parallel to the direction of insertion of the apertured latch plate 20 into the rectangular slot-like aperture 22 in the buckle 10. Shaped ejector 58 is symmetrically shaped about the longitudinal axis of the apertured base plate, and comprises a main body portion 62 which slides upon an upper surface of apertured base plate 14, a depending central portion 64 which is located within aperture 60, and ramped upper wing portions 66, only one of which is shown in the drawings. Shaped ejector 58 is biased towards the open end of the rectangular slot-like aperture 22 by means of a helical coil ejector spring 68 which is located between a rearward end of depending central portion 64 and a spring abutment 70 formed on the apertured base plate 14. When the buckle is in the unlatched position shown in FIG. 2, a forward end 72 of each of the ramped upper wing portions 66 contacts a respective abutment 74 in the push button 20 to maintain the push button in an extended position and a forward edge 78 of the main body portion 62 is positioned adjacent a forward edge 80 of aperture 60 in the base plate 14.

Operation of the Buckle

Consider firstly the buckle 10 in the unlatched condition shown in FIG. 2. In this position, the locking member 26 is retained in the raised, unlatched position by the shaped slider block 46, which is biased by compressed coil spring 54 into a position in which the cambered forward surface 50 of slider block 46 makes a line contact with the knife-like rear edge 27 of the fixed bar 18.

In order to place the buckle 10 in the latched position, the apertured latch plate 24 is inserted into the rectangular slot-like passage 22 until the cross-bar 34 of the latch plate 24 makes contact with the forward edge 78 of the main body portion 62 of ejector 58. Further insertion of the latch plate 24 pushes the shaped ejector 58 rearwardly along the apertured base plate 14, compressing the ejector spring 68, until rear faces 84 of the main body portion 62 of the ejector 58 make respective contacts with the lower, free ends of the depending legs 38 of locking member 26. The continued rearward movement of the ejector 58 caused by the further insertion of the latch plate 24 now causes the locking member 26 to pivot downwardly to insert the dependent lock bar 32 through the apertured latch plate 24 behind the cross-bar 34, and into the aperture 60 of the base plate 14, to latch the latch plate 24 securely in the buckle 10 in the position shown in FIG. 1. At the same time, the slider block 46 moves downwards with the locking member 26, with the cambered forward surface 50 remaining in sliding contact with the knife-like rear edge 27 of the fixed bar 18, until the planar portion 44 of the locking member 26 is substantially parallel to the base plate 14. At this point, the cambered forward surface 50 of the slider block 46 suddenly slides clear of the knife-like rear edge 27 of the fixed bar 18, and the slider block 46 is thrust rapidly forwards along the planar portion 44 in a snap-like manner, under the bias of coil spring 54, to the position shown in FIG. 1, where the flat upper surface 48 of the slider block 46 is in contact with the first side 19 of fixed bar 18.

In the latched position of buckle 10 shown in FIG. 1, the apertured latch plate 24 is held securely in place within the buckle 10 by reason of the dependent lock bar 32 of the locking member 26 engaging behind the cross-bar 34 of the latch plate 24. The locking member 26 is prevented from any pivotal movement upwards to release the latch plate 24 by the slider block 46 interposed between the locking member and fixed bar 18, even when the latch plate is subjected to heavy load forces tending to withdraw it from the buckle. In this respect, the dimensions of the wing portions 28 of the locking member are such that these wing portions can carry loads of up to 700 Newtons without deflection. In the event that the latched buckle is subjected to forces where the loads exerted on the wing portions 28 exceed 700 Newtons, the wing portions 28 begin to deform progressively and elastically until a forward face 86 of lock bar 32 contacts the forward edge 80 of aperture 60 in the base plate 14. At this point the lock bar 32 is held in compression between the cross-bar 34 of the latch plate 24 and the forward edge 80 of aperture 60 of the base plate 14, so preventing any further movement of any of the components of the buckle 10 or of the latch plate 24 under such excessive loads.

In the event that the latched buckle 10 is subjected to such an excessive load that it locks up as described above, once that excessive load is removed, the wing portions 28 of the locking member 26 recover elastically, so as to return the lock bar 32 to its original latched position in which the forward face 86 is spaced from the forward edge 80 of aperture 60 by a predetermined clearance indicated between the opposed arrows in FIG. 2. This predetermined clearance allows the lock bar 32 of the locking member 26 to swing upwards clear of the apertured base plate 14 during the release of the latch plate 24 from the buckle 10. Of course, it will be realised that under lower load forces on the latched buckle, this predetermined clearance between the lock bar 32 and the apertured base plate 14 is always maintained, since these lower load forces are carried by the engagement of the wing portions 28 of the locking member 26 with the respective side plates 16 of the buckle frame 12.

The latch plate 24 is released from the buckle 10 by the depression of the push button 20, which applies force to the slider block 46 through the contact of the inclined contact face 57 of the abutment 56 of the push button 20 with the cambered forward surface 50 of slider block 46. Because of the relative inclinations of cambered forward surface 50 and contact face 57, the force applied to the slider block 46 has an upward component directed towards the fixed bar 18 tending to lift both the slider block 46 and planar portion 44 of the locking member 26. Slider block 46 moves along the planar portion 44 of locking member 26, compressing coil spring 54, until the flat upper surface 48 of the slider block 46 moves out of contact with the fixed bar 18. At this point, the cambered forward surface 50 of the slider block 46 resumes contact with the knife-like rear edge, and the compressive force exerted by coil spring 54 on the slider block 46 develops an upward component also tending to lift both the slider block 46 and the planar portion 44 of the locking member 26, which, in turn, causes the locking member 26 to rotate upwards to remove the lock bar 32 from engagement with the cross-bar 34 of latch plate 24. Once this happens, the latch plate 24 is ejected from the buckle 10 by the ejector 58 under the action of the compressed ejector spring 68. The forward movement of the ejector 58 produced by the action of the compressed ejector spring 68 causes the forward ends 72 of the ramped upper wing portions 66 of the ejector 58 to contact the respective abutments 74 in the push button 20 to return the push button 20 to the extended position thereof. Thus this forward movement of the ejector 58 ensures the complete removal of the lock bar 32 from the vicinity of the latch plate 24, thus avoiding any possibility of any partial dis-engagement of the lock bar 32 with the latch plate 24.

Once the buckle is in the unlatched position shown in FIG. 2, the latching member 26 is positively retained in the upper, unlatched position shown in FIG. 2 by the spring-biased contact of the cambered forward face 50 of slider block 46 with the knife-like rear edge 27 of fixed bar 18 producing an upward bias on the latching member 26, and remains in this unlatched position until the latch plate 24 is re-inserted into the buckle 10. Consequently, this feature provides a very positive safeguard against the risks of any false latching of the buckle, since it is not possible to produce a partial engagement of the latch plate 24 in the buckle 10. Any attempt to latch the buckle which does not result in the cambered forward surface 50 of the slider block 46 being moved clear of the knife-like rear edge 27 of the fixed bar 18 will be defeated by the upward bias exerted by the coil spring 54 on the latching member 26. It is only possible to latch the buckle when the cambered forward surface 50 of the slider block 46 is moved clear of the knife-like rear edge 27 of the fixed bar 18, and, when this occurs, rapid and positive latching of the buckle is produced under the snap-action effect produced by the sudden expansion of coil spring 54.

Figure 3:
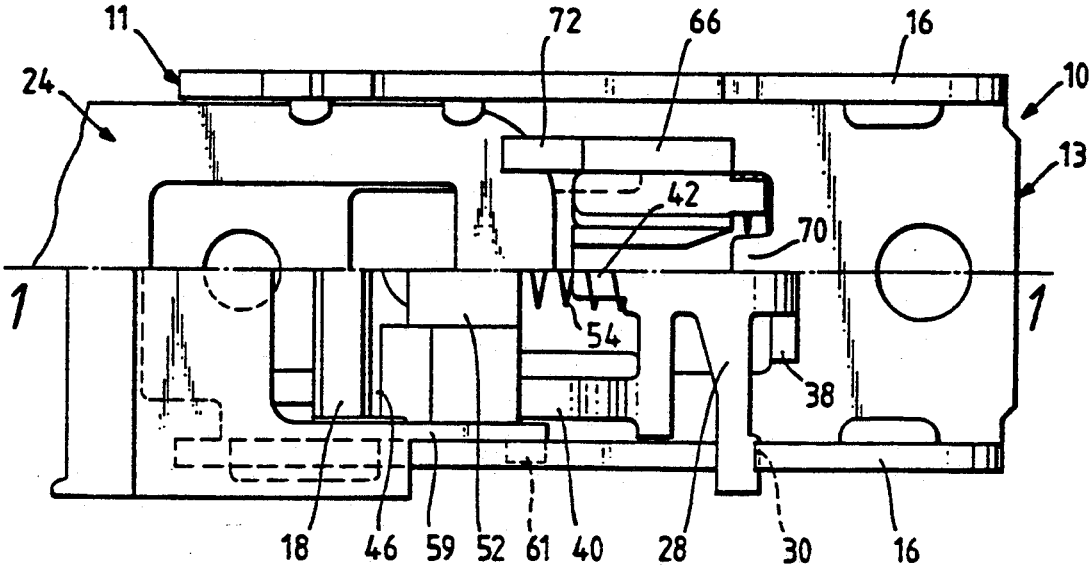
FIG. 3 is a plan view, in two sections taken along the longitudinal axis shown as A—A', of the seat belt buckle shown in FIG. 1.

With reference to FIG. 3 of the drawings, it should be noted that the forward ends 72 of the ramped upper wing portions 66 of the ejector 58 overlie portions of the latch plate 24 when the latch plate is engaged in the buckle 10. As can be seen in FIG. 1, the forward ends 72 of the ramped upper wing portions 66 of the ejector 58 are sandwiched between the upper surface of the latch plate 24 and the under surface of planar portion 44 of latching member 26 to substantially prevent any tendency of the latch plate to rattle within the buckle when fully latched therein.

The seat belt buckle of the present invention provides an effective and secure closure member for a vehicle seat belt, in which it is possible to rapidly and easily latch an associated latch plate into position in the buckle, to retain that latch plate securely in place within the buckle even under circumstances where the buckle and latch plate are subjected to high levels of loading, and to readily and effectively disconnect that latch plate from engagement in the buckle with a relatively low level of force applied to a push button release mechanism of the buckle.

We claim:

1. A seat belt buckle adapted to releasably engage with a latch plate insertable within a latch passage in the seat belt buckle, said seat belt buckle comprising: a rigid frame having an open forward end defining said latch passage, an opposite rearward end adapted to be attached to a seat belt, an apertured rectangular base plate, an upstanding side wall extending from each longitudinal edge of said base plate, and a fixed bar extending across the width of said base plate between the forward and rearward ends thereof, parallel to, and spaced apart from, said base plate, said fixed bar being secured at each end thereof to a respective side wall; a locking member pivotally supported by said frame side walls so as to pivot about an axis substantially parallel to, and spaced apart from, said fixed bar of said frame, between a latched position, in which the locking member retains said latch plate within said latch passage in the buckle, and an unlatched position, in which the locking member is held clear of said latch passage; a shaped blocking member slidably mounted upon said pivoted locking member for longitudinal movement relative to said locking member between a first position, where the locking member is in said latched position and the blocking member is interposed between said fixed bar and said locking member to block any pivotal movement of the locking member towards said unlatched position, and a second position, where the locking member is in said unlatched position and the blocking member engages the fixed bar to retain the locking member in said unlatched position; a push button slidably mounted on said frame side walls above said latch passage, for longitudinal movement relative to the frame base plate so as to move said blocking member from said first position to said second position; and a spring means located between the blocking member and the locking member which biases the blocking member towards said first position; the fixed bar being provided with a substantially knife-edged portion which faces the rearward end of the buckle and extends across the width of the base plate; and the shaped blocking member being provided with a sloping face which makes essentially a line contact with the substantially knife-edged portion of the fixed bar throughout the pivotal movement of the locking member from said unlatched position to a position in which the spring means can snap the blocking member into said first position.

2. A seat belt buckle according to claim 1, in which the sloping face of the shaped blocking member is a cambered surface which is inclined towards a substantially planar portion of the locking member upon which the shaped blocking member is slidably mounted.

3. A seat belt buckle according to claim 1, in which the shaped blocking member is formed from a high strength, mouldable synthetic plastics material.

4. A seat belt buckle according to claim 3, in which the shaped blocking member is formed from a linear polyoxymethylene-type acetal resin produced from the polymerization of formaldehyde.

5. A seat belt buckle according to any one of the preceding claims, in which the fixed bar is a steel bar having a trapezium-shaped cross-section comprising a first side, a second side opposed to, and parallel to the first side, and two remaining sides which are opposed and non-parallel to one another and converge from said first side towards said second side, said fixed bar having said first side facing downwards towards the base plate of the frame; and the substantially knife-edged portion is formed by the edge of the bar between said first side and the non-parallel side which faces the rearward end of the buckle.

6. A seat belt buckle according to any one of claims 2 to 4, in which an abutment on the push button engages the cambered surface of the shaped blocking member in order to move the shaped blocking member from said first position to said second position, said abutment being provided with a sloping contact surface which is complementary to the cambered surface of the shaped blocking member.

* * * * *